US008595963B2

(12) United States Patent
Olivarez et al.

(10) Patent No.: US 8,595,963 B2
(45) Date of Patent: Dec. 3, 2013

(54) DEVICE AND METHOD FOR LABELING WIRES AND PROTECTING THE LABELS DURING THE WIRE INSTALLATION PROCESS

(76) Inventors: Robert J. Olivarez, Moorestown, NJ (US); Thomas A. Prosser, Ocean View, NJ (US)

( * ) Notice: Subject to any disclaimer, the term of this patent is extended or adjusted under 35 U.S.C. 154(b) by 4 days.

(21) Appl. No.: 13/169,708

(22) Filed: Jun. 27, 2011

(65) Prior Publication Data

US 2012/0198738 A1 Aug. 9, 2012

Related U.S. Application Data

(60) Provisional application No. 61/440,543, filed on Feb. 8, 2011.

(51) Int. Cl.
*G09F 3/00* (2006.01)

(52) U.S. Cl.
USPC ..... 40/316

(58) Field of Classification Search
USPC ..... 40/316, 309, 6, 633
See application file for complete search history.

(56) References Cited

U.S. PATENT DOCUMENTS

| | | | | | |
|---|---|---|---|---|---|
| 2,170,147 | A | * | 8/1939 | Lane | 206/447 |
| 2,818,168 | A | * | 12/1957 | Tobey et al. | 206/447 |
| 2,831,277 | A | * | 4/1958 | Strachan | 206/447 |
| 2,914,166 | A | * | 11/1959 | Bihler | 206/526 |
| 4,578,136 | A | * | 3/1986 | Brown | 156/249 |
| 4,579,759 | A | * | 4/1986 | Breuers | 428/375 |
| 4,609,208 | A | * | 9/1986 | Wrobel | 283/81 |
| 4,884,827 | A | * | 12/1989 | Kelley | 283/81 |
| 5,279,057 | A | * | 1/1994 | Melin et al. | 40/630 |

* cited by examiner

*Primary Examiner* — Kristina Junge
(74) *Attorney, Agent, or Firm* — Montgomery, McCracken, Walker & Rhoads, LLP

(57) ABSTRACT

Provided are a device and method for rapidly and efficiently labeling wires or cables to be installed in machinery, vehicles, computers, buildings, or other structures, whether the wires are new installations or are replacing presently existing wires. In particular, the invention is a multi-sectioned wire-label which adheres to a wire and is self-protective, thus reducing the likelihood of damage to the label during the wire-installation process. The invention also describes multiple storage forms for pluralities of the wire-label, and a method for use of the wire-label itself.

20 Claims, 7 Drawing Sheets

DEVICE AND METHOD FOR LABELING WIRES AND PROTECTING THE LABELS DURING THE WIRE INSTALLATION PROCESS

CROSS-REFERENCE TO RELATED APPLICATIONS

The present invention claims priority to U.S. Provisional Application Ser. No. 61/440,543, filed on Feb. 8, 2011, which is incorporated herein in its entirety.

FIELD OF THE INVENTION

The present invention relates to systems and methods for rapidly and efficiently creating a wire label, for protecting the wire label during wire installation or handling, and for revealing the undamaged wire label for identifying the wire after installation.

BACKGROUND OF THE INVENTION

When buildings are constructed, access to external utilities such as electricity, telecommunications, such as fax or telephone, computers, routers, television, cable service, security service and the like is generally provided from one or more central access points. However, access to these utilities is often needed in rooms other than the one containing the central access point. As a result, distribution systems are frequently set up at the central access point. In the electrical arts, one example of a distribution system is known as a "breaker box" or a "panel." Wires can be used to connect various rooms within the building to this distribution system, allowing for access to the external utilities from any of the appropriately connected rooms. In the electrical arts, extending a wire from the room of interest to the distribution system is known as a "home run."

Access to external sources or power (electricity) may be divided among several circuits, also known as branch circuits, wherein each circuit is dedicated to a specific area or point in the building. Multiple circuits permit repair or rerouting of the power if an issue arises in one circuit, without necessarily affecting the others, and branch circuits reduce the load on each line. Accordingly, the use of multiple wires for connecting various utilities and services, permits multiple rooms to have access to the same services.

To complete the wiring in a distribution system requires that the wires must be accurately connected, but that requires an understanding of the location and endpoints of each wire. However, the end point of a wire is not visible when multiple rooms or floors are involved in a system, or in large commercial projects, wherein thousands of wires may be run over acres of floor space. As a result, prior to running or connecting a wire in the distribution system, an installer must be certain of the location each wire at its position distal to the junction or breaker box, panel or power source. To avoid the time consuming process of trying to determine the source of each wire in a circuit, or conversely the end point from the junction or breaker box, panel or power source, wire installers need to try to label each wire in advance of installation, so that accurate connections can be made.

The problem arises when installing wires on site, either in new construction or reconstruction projects, or in rewiring or remodeling a project. One of the primary challenges is maneuvering the wire from it starting point to its intended end point, referred to as "pulling" the wire. In the earliest stages of construction, there are very few impediments to the installation of wire. However, as construction progresses, and walls and floors are put into place, the challenges of pulling a wire from one point to another dramatically increase, and the number of wires may increase exponentially. Without a reliable wire label at the end of the wire being connected, the wires essentially all look the same, making accurate connection impossible. At the same time, as more of the building is completed, there are more locations for the pulled wire to get caught or hung up during installation, meaning that even if the wire end has been labeled by prior art processes, the label may be damaged or completely torn away as it is routed through walls, floors or various structures. In some cases, a bulky or torn label may hold the wire in place as it is being pulled, and prevent it from moving to its intended end point.

The impediments to running a wire from one location to another are not limited to structural elements, but can also include other internal networks, such as plumbing, previously installed wiring systems, or other types of wiring, and the like, particularly since installation can occur at any point in the construction or life of a building, vehicle, machinery or other wiring project or device. While initially considered in terms of wiring for a building, the same principles are applied in any wiring system, such as for vehicles, computer systems, and the like. Consider the wiring in the Space Shuttle, where accuracy of each the connection is critical, and the power source may not be visible at the wire end to ascertain the origin. As a result, this need for accuracy makes the need for a reliable wire label system important any time wires are run in any situation in which the two ends of the wire are not simultaneously visible or identifiable, or when there are simply too many wires to distinguish one from another.

Of course, any external label is affixed to a wire being pulled, is subject to the same hazards as the wire during installation. As a result, the prior art provides labels which have proven to be subject to getting caught, hung up, damaged, or even torn off during the wire installation process, making the wire label or possibly even the wire useless without a legible label. Accordingly, installers have tried many ways, albeit with limited success, of labeling wires using home-made techniques. For example, in the electrical arts, installers may use color or tape to try to create labels, but clearly this is limited by the number of distinctly different colors that are available, whereas thousands of wires may need to be distinguished in commercial projects.

When tape is used, before labeling each wire, the tape must be taken from a roll and some process of back-folding of the tape may be used to create a non-adhesive writable surface resulting in a type of wire label, and then the tape may be applied to the wire. Each home-made label of this type may take only a few minutes to create, but when multiplied by thousands of wires, any system in which a label must be custom made for each wire by hand using make-shift materials is prohibitive, and wastes precious time of a skilled electrician during costly construction or wiring projects. Even if the custom or prior art labels are suitably attached to the wire, the labels are still susceptible to damage or destruction as the wire is pulled. Sometimes an additional tape is added to try to protect the wire label, but this adds yet another step to the labeling process, requiring even more of the installer's time, plus additional tape materials, which are not always available at the job site. Using electrical tape for this process may also leave a sticky residue making separation difficult or causing the written portion of the label to be illegible when it is needed.

In its simplest form, wire installation involves routing the wire in the distribution system from the junction or breaker box, panel or power source to the end point location where service is desired. However, wires often run for significant distances, and in some cases it may be beneficial to label both ends of the wire for accuracy or to save time the may be needed to re-trace a wire, but that, of course doubles the time that the installer must spend preparing and attaching the wire labels. Moreover, the labeling process may need to be repeated for some, if not all, of the wires that must be connected, and in high energy buildings, such as casinos with wiring to thousands of machines, it is not uncommon for tens or hundreds of thousands of home run wires to be installed, each of which requires the generation and application of a label, or even two labels.

Previous methods for the labeling of wires are described in U.S. Pat. Nos. 7,745,740 and 4,609,208. Additionally a system for the labeling of electrical cables is the subject of Published U.S. Patent Application 2009/0241384. But such labels are ineffective, and are readily damaged as the wires are pulled during installation, as is also true for other prior art wire label systems.

As a result, until the present invention, there remained an unmet need for wire-labeling systems and methods that can provide for rapidly and efficiently, and more importantly reliably, labeling of wires that are being installed, or that have been installed, regardless of whether they are in a building, computer, vehicle or machinery or any other wired system under construction or being remodeled or rewired. The prior art provides no efficient or reliable means for protecting those wire labels during installation of the wires, while at the same time leaving a label that may be easily read at any point during or after wire installation or after connection to or completion of the distribution system.

SUMMARY OF THE INVENTION

The invention provides a device, referred to as a "label-unit," for labeling wires, the device having two planar sides and at least three distinct sections. The first section of the label-unit provides for attachment of the label-unit to the wire to be labeled. The second section of the label-unit provides for written and/or pre-printed indicia to appropriately identify the wire. The third section of the label-unit protects the label-unit during the installation process.

The invention contemplates a plurality of label-units being stored in "label-roll" form, wherein a series of label-units are connected sequentially to one another, end to end. The plurality of label-units has two ends, a terminal end affixed to a "roll-core," and a dispensing end, immediately accessible to the electrician. The plurality of label-units is wrapped around an axis located at the center of the roll-core.

The invention also contemplates a plurality of label-units being stored in "label-book" form, wherein the labels constitute a "ply," with a series of plies overlaid on top of one another.

The invention also provides a method for use of the wire-label wherein written indicia are added to a label-unit, the label-unit is secured to a wire, the label-unit protects itself from damage during the installation process, a portion of the label-unit is optionally removed after installation, and written indicia on the label-unit are reviewed so that an electrician can be certain of the origin of the wire.

Additional objects, advantages and novel features of the invention will be set forth in part in the description, examples and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE FIGURES

The following detailed description of the invention will be better understood when read in conjunction with the appended drawings. It should be understood, however, that the invention is not limited to the precise arrangements and instrumentalities shown.

FIG. 5A shows the location of the gripping section in relation to two adjacent label-units. FIG. 5B shows the gripping section remaining attached to the label-roll after an individual label-unit has been removed from the roll.

FIG. 6A shows a book form of the label-units with the first section, second section, and third section of the label-units identified. FIG. 6B shows a side view of a book form of the label-units including the optional gripping section, with the first section, second section, third section, and gripping section identified.

FIG. 7A shows the label-unit being attached to a wire via a first section. FIG. 7B shows the label-unit after the first section of FIG. 7A has been completely wrapped around the wire. FIG. 7C shows the label-unit after a second section or printable label of FIG. 7B has been completely wrapped around the wire, covering the first section of FIG. 7A. FIG. 7D shows the label-unit after a third section has been completely wrapped around the wire, covering the second section of FIG. 7C and the first section of FIG. 7B beneath it.

FIG. 8A shows the label-unit after the third section of FIG. 7D has been unwrapped and detached from the second section of FIG. 7C. FIG. 8B shows the label-unit after the second section of FIG. 7C has been unwrapped and extended, so that the indicia on the second section of FIG. 7C can be read.

DESCRIPTION OF CERTAIN EMBODIMENTS OF THE INVENTION

Figure 1:
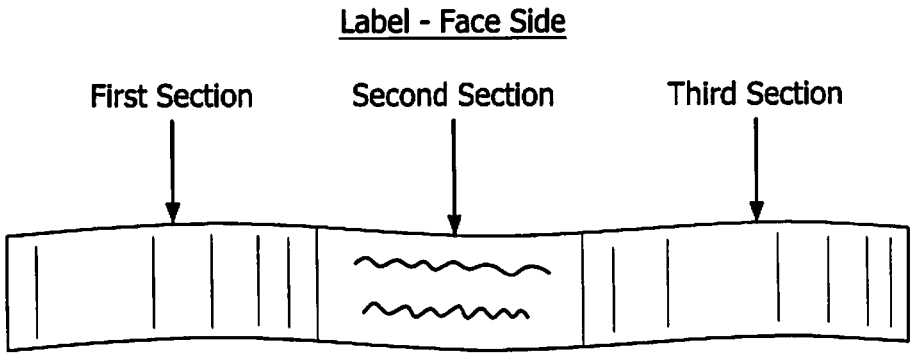
FIG. 1 shows a view of a label-face side of a label-unit, with the first section, second section, and third section being identified.

Wires are used to transmit electricity, information, and other signals from one location to another. "Wires" as used herein shall be understood to mean single or multiple strands, as well as conduit or similar materials enclosing such strands.

Access to utilities, such as electricity, services such as telephone or security systems, and information sources such as computer and internet accessibility, is often desired in more than one location within a structure. Because these utilities, services, and information sources often only have one point of entry into the structure, distribution systems become necessary in order to facilitate access to the utility, service, or information source at a location other than the point of entry. Dependent upon both the size of the structure and the complexity of the distribution system, hundreds or thousands of wires may be required in order to provide access to the utility, service, or information source in all of the desired locations within the structure. With the benefit of this disclosure, one skilled in the art would understand that although description is provided for electrical wires, the invention described is not limited to electrical wires, but would also be applicable to any wire or cable, including but not limited to: telephone wires, telecommunications wire, coaxial cable, fiber-optic cable, and wiring used in security systems where the beginning of the wire or source location is not readily visible to at the opposite end of the wire.

Construction of business and residential buildings often requires that a variety of wires be installed. In residential buildings, the wiring to be installed may accept markings directly. However, due to safety regulations, the wiring used in commercial buildings often cannot accept direct markings. Further, the wires may be coated or greasy, and thus, additional labels must be affixed to the wires. In one embodiment of the present invention a label-unit is designed to be affixed to commercial wires regardless of whether they will accept direct markings or not. Therefore, the term "wire" as used herein means any wire, cable, or conduit, including but not limited to MC Cable, Romex, and Direct Burial Cable and the like, further including wires and cables that have not yet been developed, but which may need such labels.

As the invention is described herein with respect to the electrical arts, the installer is referred to as an "electrician." However, as has been discussed above, the invention is not limited to electrical wires, and thus "electrician" shall be used herein to mean any installer of wires. Additionally, as one type of "distribution system" in the electrical arts is known as a "breaker box," the distribution system will hereafter be generally referred to as a "breaker box." However, because the invention is not limited to electrical wires, the term "breaker box" shall be used herein to mean any type of distribution system for connecting to a desired utility, service, or information source.

Any wires in a building, machinery, telecommunications, computer, vehicle and the like, or in a building, or other wiring project or device under construction in a wired system will benefit from labeling with the invention as described herein. Moreover, any electrician will benefit from the increased efficiency gained from the use of this invention. The invention has been tested on metal-clad and other cables as shown in the Figures, but is not so limited. The materials used in construction of the label-unit may be varied so that the label-units can be applied to any type of wire.

The label-units will be defined in terms of sections, which comprise a variety of materials. For example, the materials may be resistive or conductive of electricity, as needed or desired. Similarly, the materials may be water-resistant, or bio-degradable, as needed or desired. As such, the present invention is not limited to the specifically exemplified materials. For the purposes of this disclosure, "labeling" shall be understood to mean the addition and usage of written and/or pre-printed indicia to indicate the source of the wire or to what utility, service, etc., the wire should be connected.

Label-Unit

One aspect of the invention is a labeling device for wires, referred to as a "label-unit" which may be used to label wires prior to installation. The label-units are self-protected throughout the installation process, allowing electricians to efficiently and reliably connect wires to breaker boxes once installation has been completed.

The label-unit has two planar sides: a label-face side, and a label-back side, opposite to one another. Each label-unit has two ends that are perpendicular to the longitudinal axis of the planar sides. The longitudinal length of each label-unit is transversely subdivided into a minimum of three sections, which are operably connected in the following order: a first section, a second section, and a third section. Each section has two longitudinal ends, the proximity of each will be described in greater detail below.

For the purposes of this disclosure, "tape" shall be understood to refer to any pre-existing adhesive material, including, but not limited to duct tape, masking tape, transparent adhesive tape, or electrical tape, or any pre-existing non-adhesive material, including, but not limited to non-adhesive tapes, papers, fabrics, and plastics, to which a pressure-sensitive adhesive could be suitably applied for the purpose of creating an adhesive material.

In one embodiment, the tape or tapes used in each section of the label-unit are either opaque or transparent. Alternatively, the label-unit is made up of both opaque and transparent tapes, and is manufactured by any method known in the art, including but not limited to, selectively attaching an opaque tape to a transparent tape.

The tape or tapes used to make the label-unit may be monochromatic, multicolored, or patterned.

In various embodiments, the tapes used to make the label-unit are single-layered or multi-layered.

The tape or tapes used in each section of the label-unit are thus any combination of opaque, transparent, monochromatic, multicolored, patterned, single-layered, or multi-layered.

Each section of the label-unit is constructed of a "tape" (as tape is defined herein), and depending upon the type, size, or material composition of the tape, it exhibits various levels of expansion, contraction, and flexibility without damage to the first section. In order to facilitate such flexibility, it is anticipated that the thickness of a label-unit made with currently known materials is between 2 and 20 mils, between 10 and 20 mils, between 15-20 mils, or is not to exceed 20 mils. However, with future advancements in materials science, more flexible materials may be developed and allow for thicker label-units to be produced.

The first and third sections of the label-unit have two planar surfaces, referred to as "sides," one of which is adhesive side and the opposing side is a non-adhesive side. The adhesive side corresponds to the label-back side of the first and third sections, while the non-adhesive side corresponds to the label-front side of the first and third sections. The first and third sections of the label-unit have a predetermined length and width. The first and third sections of the label unit each have two ends. The "first end of the first section" shall be understood to mean the end of the first section which is distal to the second section. The "second end of the first section" shall be understood to mean the end of the first section which is proximal to and connected to the second section. The "first end of the third section" shall be understood to mean end of the third section which is proximal to and connected to the second section. The "second end of the third section" shall be understood to mean the end of the third section which is distal to the second section.

Because wire is available in a variety of sizes, it is anticipated that the label-units are producible in numerous sizes. In order to facilitate secure attachment to a wire, the first and third sections must each be of a length that is equal to or greater than the circumference of the wire to which the label-unit is attached.

The second section is constructed of a tape or other suitable material, which provides a writable surface for labeling the label-unit by adding written and/or pre-printed indicia on one or both sides of the second section, or provides a pocket into which a label may be inserted, without damage to the second section. Additionally, when the label-unit is applied, the second section is wrapped around the wire being labeled without incurring damage to itself or causing damage to other sections of the label-unit or the wire itself. Based upon the material selected for the second section, writings, markings or indicia comprise those made by pen, pencil, marker, or other suitable implement, or such writings. markings or indicia may be printed or pre-printed. In an alternative embodiment, a separate, external label may be created and inserted in a pocket created by the second section. However, the second section exhibits no adhesive properties on either planar surface.

The second section of the label-unit has a predetermined length and width. The length and width of the second section need not be the same as that of the first or third sections.

Figure 2:
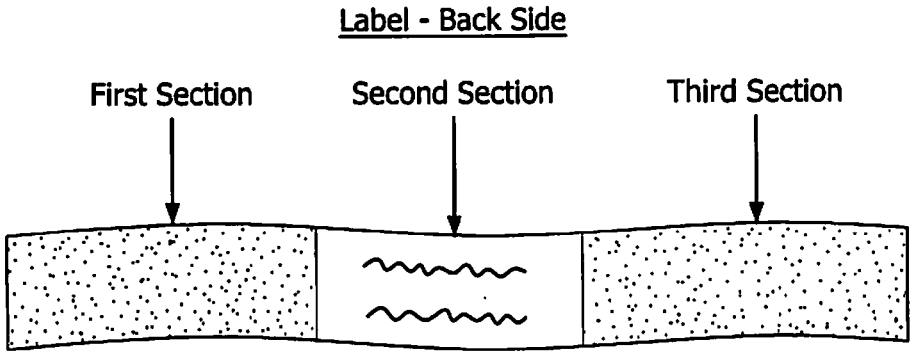
FIG. 2 shows a view of a label-back side of a label-unit, with the first section, second section, and third section being identified.

The first, second, and third sections of the label-unit are connected in continuous and operable sequence, such that the first section is connected to the second section, which is in turn connected to the third section. The sections are oriented so that the non-adhesive sides of the first and third sections correspond to the label-face side of the label-unit, as shown in FIG. 1. Similarly, the sections are oriented such that the adhesive sides of the first and third sections correspond to the label-back side of the label-unit, as shown in FIG. 2. When a plurality of label-units are stored in label-roll form, the third section of one label-unit is connected to the first section of an adjacent label-unit.

In one embodiment, the second section is constructed of two tapes, only one of which has an adhesive side, wherein the tape without the adhesive side is mounted to the tape with the adhesive side by being placed in contact with the adhesive. In this way, the adhesive side of one tape is encapsulated by the two non-adhesive sides of the different tapes, allowing for marking on the outermost non-adhesive sides of the tapes. In an alternative embodiment, the second section is constructed of one or more tapes with adhesive sides which are affixed to one another such that the adhesive sides are in contact, allowing for marking on the outermost, non-adhesive sides of the tapes.

In one embodiment, the second section is constructed of two transparent tapes, capable of being joined together through methods known in the art, including, but not limited to, application of an adhesive, heat bonding, or the application of a primer and bonding agent. The joined materials create a pocket in which an independent label may be inserted. Insertion of the independent label takes place prior to the joining of the two materials, and/or the pocket of the second section is designed so that one side remains open, allowing for insertion of the label after the two materials are joined.

In one embodiment, the label-unit comprises a fourth section, referred to as a "gripping section." The purpose of the gripping section is to provide a piece of the label-unit which the electrician may manually hold when separating one label-unit from another or from the chosen storage form, such as a label-roll or a label-book, or simply for ease of handling, particularly if the wires or the electrician's hands are dirty or greasy. The gripping section has two planar sides corresponding to the label-face side and label-back side of the label-unit. The gripping section is constructed of one or more tapes with no external adhesive properties. The gripping section is of a predetermined length and width.

Operable Arrangement of a Label-Unit

In all embodiments, the first, second, third, and optional gripping sections each have two ends. The three sections of the label-unit are arranged in the same order: first, second, third. One end of the first section is connected to one end of the second section. The opposing end of the second section is then connected to an end of the third section. The first, second, and third sections are operably connected, such that the orientation of the adhesive side of the first and third sections, respectively, is on the same planar side of the label-unit. Thus, the label-back side of the label-unit contains the adhesive sides of the first and third sections, while the label-front side of the label-unit contains the non-adhesive sides of the first and third sections.

In label-roll embodiments, successive label-units are connected to one another such that the third section of one label-unit is connected to the first section of the adjacent label-unit via the ends of the third and first sections, respectively, which are not connected to an adjacent second section. The sections are oriented such that the adhesive sides of the first and third sections of all units are located on the label-back side of the label-unit. The plurality of label-units are connected to one another such that the label-back side of one label-unit is located on the same planar side as that of each adjacent unit, creating a series of label-units which, when wrapped around a roll-core consistently maintain an orientation wherein the label-back side of a label-unit is proximal to the roll-core and the label-front side of a label unit is distal to the roll-core.

In label-roll embodiments including a gripping section, the third section of one label-unit is instead connected to an end of the gripping section. The opposing end of the gripping section is then connected to an end of the first section of the adjacent label-unit.

In book-form embodiments including a gripping section, the gripping section is connected to the first or third section via the end of the section which is not connected to an adjacent second section.

In one embodiment, all sections of the label-unit are of the same color or pattern. Alternatively, in another embodiment, the label-unit uses two or more colors or patterns of tape to differentiate the various sections of the label-unit. Varying the colors or patterns of the label-units, whether the label-units themselves are monochromatic or multi-colored, or multi-patterned, allows for further differentiation and organization of the wires being labeled. Moreover, either opaque and/or transparent materials are utilized in certain embodied constructs of the label-unit, wherein the first and second sections are opaque, but the third section is constructed of a transparent tape or tapes. This embodiment renders the third section a transparent overlay for the second section, allowing the markings on the second section to be read even when the third section is wrapped over the second section containing the written indicia.

In another alternative wherein the label-unit is constructed of both opaque and transparent materials, at least the first or third sections are constructed of a tape or tapes which are transparent. In this embodiment, the third section again serves as a transparent overlay for the second section, allowing the indicia on the second section to be read, even when the third section is wrapped around it. Further, once the third section has been removed and the second section has been unwrapped from the wire, the transparent nature of the first section allows for any markings made directly on the wire to be read while the label-unit remains attached to it.

Label-Roll Embodiment

In one embodiment, the label-units are manufactured in the form of a label-roll. For the purposes of this disclosure, a "label-roll" is understood to mean a plurality of label-units, assembled in series and connected end-to-end to one another such that the end of a first label-unit is connected to one end of an adjacent label-unit, the opposing end of which is connected to another adjacent label-unit in a repeating pattern.

Figure 3:
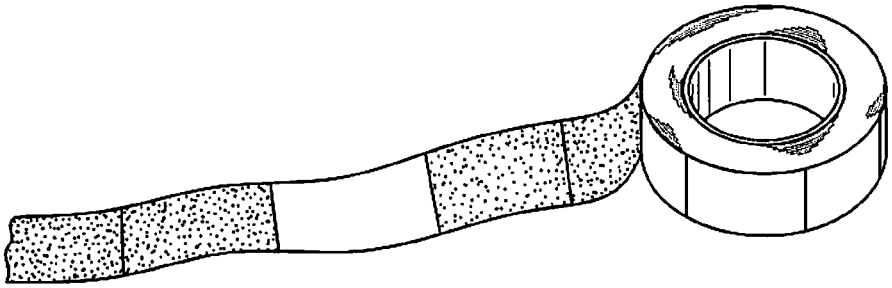
FIG. 3 shows a plurality of label-units in label-roll form.

The plurality has two planar sides: a label-face side and a label-back side. The label-units are arranged such that the adhesive sides of the first and third sections correspond to the label-back side of the label-unit. Each label-unit is connected to an adjacent label-unit such that label-back sides of the label-units correspond to the label-back side of the plurality of label-units. The label-roll has two ends: a dispensing end and a terminal end. A plurality of label-units in label-roll form is shown in FIG. 3.

Figure 4:
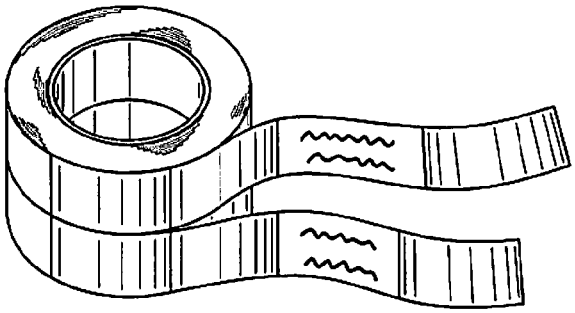
FIG. 4 shows a plurality of label-units stored in label-roll form, in which the roll-core is wide enough to accommodate two rolls of label-units.

For the purposes of this disclosure, a "roll-core" shall be understood to mean a cylindrical structure to which a plurality of labels are attached and wound around. Alternative embodiments of the roll-core include ring structures, which are hollow and lack material at their centers, and disc structures, which are solid throughout. In one embodiment, the roll-core is of a width allowing for only one plurality of label-units. In another embodiment, the roll-core is of a width allowing for two or more pluralities of label-units to be affixed to the roll-core. With the benefit of the present disclosure, one skilled in the art will recognize that various diameters of roll-cores are possible, and that various benefits are available for each size diameter. As an example, larger diameter roll-cores allow for the roll of label-units to be carried on the electrician's arm, for easier marking of the label-units while still attached to the roll, and for differentiation from other rolls of tape in the electrician's possession. FIG. 4 depicts an embodiment in which two pluralities of label-units are stored in label-roll form, wherein the roll-core is wide enough to be carried on the electrician's arm, accommodates two rolls of label-units, and has a radius large enough to facilitate easier marking of the label-units while they are attached to the roll-core.

The terminal end of the label-roll is attached to a roll-core, and the plurality of label-units is wound longitudinally around an axis located at the center of the roll-core, creating a label-roll with a plurality of overlapping layers, with the outermost layer terminating at the dispensing end of the plurality. The orientation of the attachment of the plurality to the roll-core results in the label-back side of each label-unit being proximal to the roll-core and the label-front side of each label-unit being distal to the roll-core.

In one embodiment, the label-roll is a plurality of label-units which only contain first, second, and third sections, and which are continuously and sequentially connected to one another via the third section of one label-unit and the first section of an adjacent label-unit, as described above.

Figure 5A:
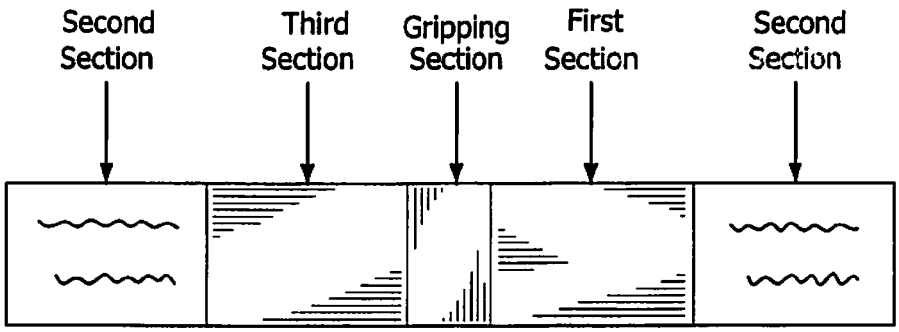
FIGS. 5A-5B show a plurality of label-units stored in label-roll form, in which a "gripping section" is incorporated into the label-unit.

An alternative embodiment of the label-roll includes a gripping section, which is located between adjacent label-units and is connected to both the third section of one label-unit and the first section of an adjacent label-unit. See FIG. 5A.

An additional embodiment of the label-roll includes repeated lines or perforations at the point at which each first end of the first section of one label unit is operably connected to the second end of the third section of a preceding label unit of the plurality, perpendicularly-oriented and transversely crossing the continuous roll of label-units, thereby separating each label-unit from the adjacent label-unit. The line or perforation indicates the end of one label-unit and the beginning of an adjacent label-unit.

Figure 5B:
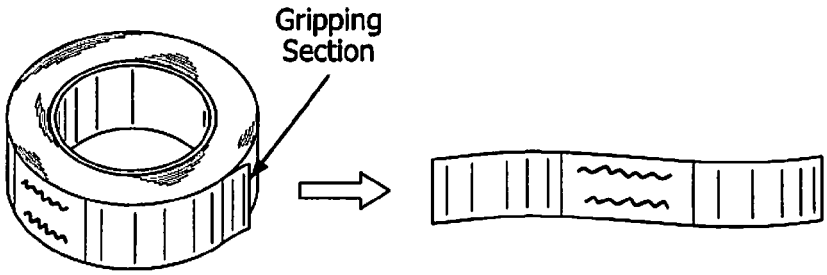

In label-roll embodiments, the label-unit is removed from the roll by peeling back the label-unit until it has been completely released from the roll, and then detaching the desired label-unit at the location where it is connected to the next label-unit. In label-roll embodiments containing a gripping section, removal of the label-unit from the roll is facilitated by the gripping section of the label-unit, which allows the electrician to hold the label-unit without damaging any other section, peel back the label-unit until it has been released from the label-roll, and detach the label-unit at the location where it is connected to the next label-unit, such that the gripping section of the next label-unit remains connected to the label-roll and extends outward therefrom for ease of removal of the next label-unit. See FIG. 5B. Written indicia and/or pre-printed labels are added either before and/or after the label-unit has been detached from the roll. Additionally, indicia may be added to one planar side of the label-unit prior to detachment from the roll, and then added to the other side of the label-unit after detachment from the roll.

Through methods well-known in the art, including but not limited to the use of liners, release coats, and pressure-sensitive adhesive, the label-roll is constructed such that when a label-unit is removed from the outermost layer of the label-roll, the pressure-sensitive adhesive on the label-back side of that label-unit remains attached and retains its adhesive qualities without having transferred any of the pressure-sensitive adhesive to the layer of label-units beneath it.

Label-Book Embodiment

In one embodiment, the label-units are manufactured in the form of a label-book. For the purposes of this disclosure, a "label-book" should be understood to mean a plurality of label-units, wherein each label-unit constitutes a ply, and one ply is symmetrically and repeatedly overlaid on top of another ply, until a user-defined number of plies have been stacked. Through the usage of technology known in the art, including but not limited to, liner sheets, release coats, and pressure-sensitive adhesive, the plies of label-units are connected to one another such that, upon removal of a top ply from the ply beneath it, the pressure-sensitive adhesive on the label-back of the top ply remains attached to that ply and retains its pressure-sensitive adhesive quality without having transferred any of the pressure-sensitive adhesive to the ply beneath it. In this way, an electrician may make use of the top label-unit, remove it from the book, apply it to the appropriate wire, and have access to the next label-unit.

Figure 6A:
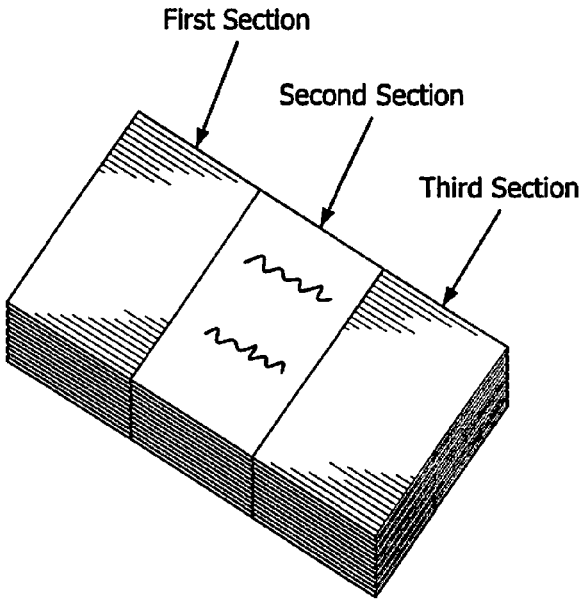
FIGS. 6A-6B show a plurality of label-units in which the label-units are stored in book form.

In one embodiment, the label-book is constructed of a plurality of label-units overlaid in a single stack. See FIG. 6A. Alternative embodiments include constructing the label-book of one or more pluralities of label-units, overlaid such that multiple stacks are created and joined together.

In one embodiment, the plies of the label-book are oriented in the same direction such that the label-back of an upper ply is adjacent the label-face side of the ply beneath it. In another embodiment, the plies of the label-book are oriented in an alternating manner such that similar sides of plies are adjacent to one another. For example, in a label-book of three plies, top, middle, and bottom, the label-face side of the top ply is at the top of the book, the label-back side of the top ply is adjacent to the label-back side of the middle ply, the label-face side of the middle ply is adjacent to the label-face side of the bottom ply, and the label-back side of the bottom ply is at the bottom of the label-book.

In label-hook form embodiments, the label-unit is removed from the label-book by peeling back the label-unit until it has been completely released from the book. In label-book form embodiments containing a gripping section, removal of the label-unit from the label-book is facilitated by the gripping section of the label-unit, which allows the electrician to hold the label-unit without damaging any other section and peel back the label-unit until it has been released from the label-book. Written indicia and/or pre-printed labels are either added to the label-unit prior to and/or after detachment from the label-book. Additionally, written indicia and/or pre-printed labels are added to one planar side of the label-unit prior to detachment from the label-book and/or to the other planar side of the label-unit after detachment from the label-book.

Figure 6B:
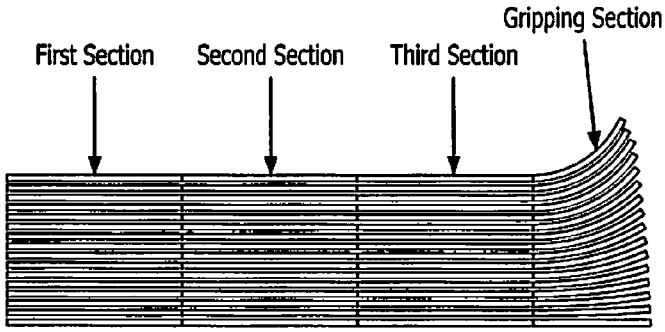

In one embodiment of the label-unit, a gripping section is connected to the first section of each label-unit. In an alternative embodiment, the gripping section is connected to the third section of each label-unit. See FIG. 6B.

Operable Method of Use

The invention also contemplates the manner in which the labeling device described above may be employed. In embodiments where the third section of the label-unit is opaque, practice of the invention involves the following steps.

Figure 7A:
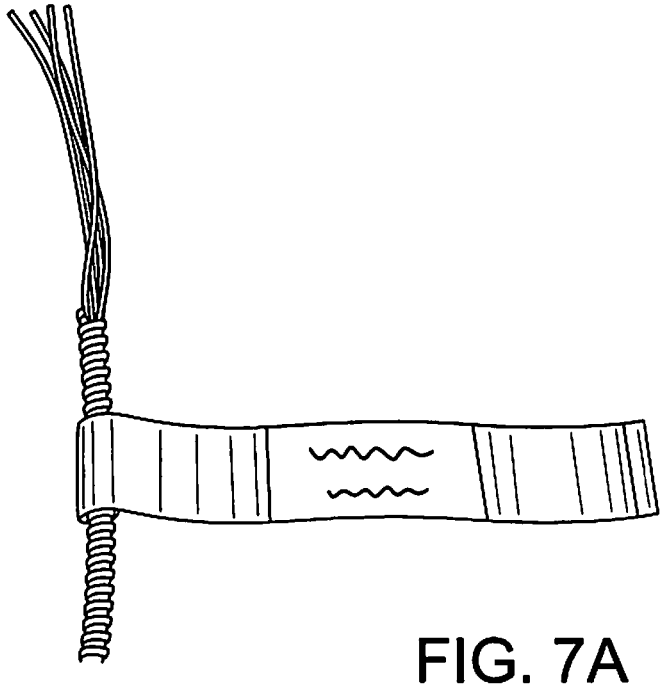
FIGS. 7A-7D show the application of the label-unit to a wire.
Figure 7B:
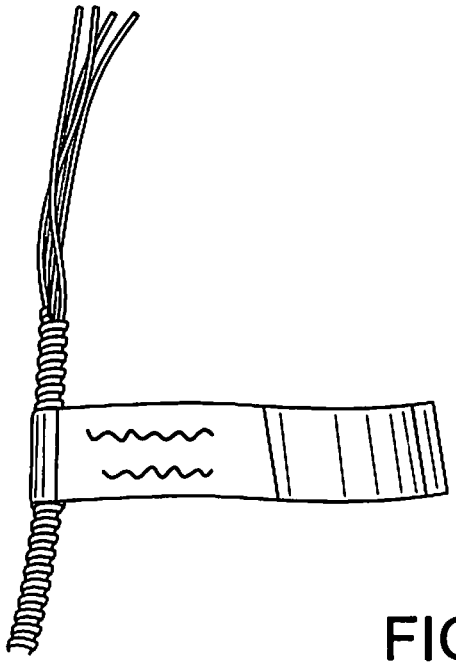
Figure 7C:
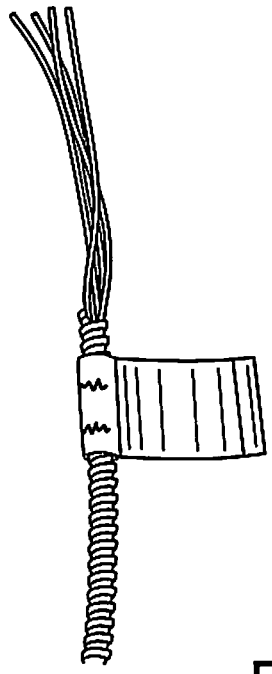
Figure 7D:
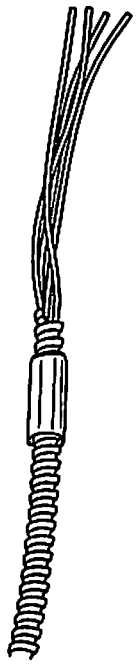

The first section of the label-unit is applied to one end of the wire as shown in FIG. 7A. The label-unit is wrapped around the wire until the entirety of the first section has been applied to the wire, as shown in FIG. 7B. The label-unit continues to be wrapped around the wire until the second section has been completely wrapped around the wire and the first section, as shown in FIG. 7C. The label-unit is further wrapped around the wire, first section, and second section until the third section has been completely applied and appropriately covers and protects the second section of the label-unit, as shown in FIG. 7D. The process is then repeated with a new label-unit for the opposite end of the wire. The wire can then be installed.

Figure 8A:
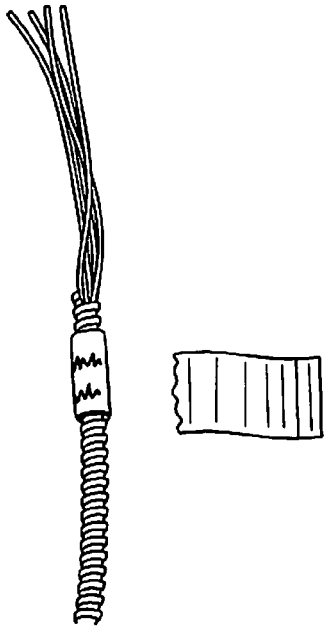
FIGS. 8A-8B show the removal of the third section and exposing of the second section.
Figure 8B:
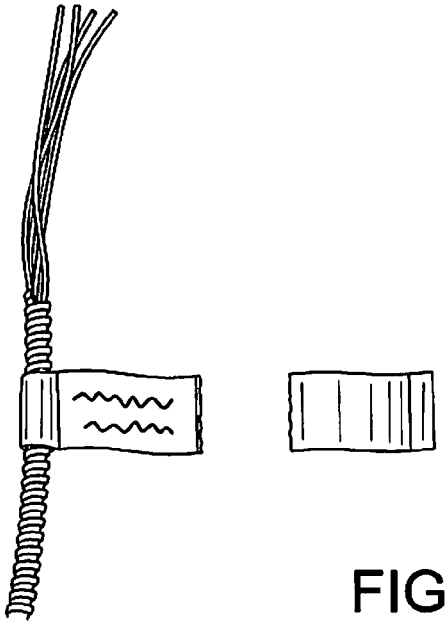

Upon completing the wire installation, the third section of the label-unit is unwrapped until reaching the proximal end of the operably connected second section, as shown in FIG. 8A. The second section is thereby exposed, after having been protected from damage during the installation process, as shown in FIG. 8B. At this point, the third section is optionally disconnected or torn away from the second section. Accordingly, it is now possible for an electrician to review the exposed second section and the written indicia thereon, to accurately identify the wire, permitting it to be connected appropriately to the breaker box.

In embodiments where the third section is transparent, the electrician then proceeds as outlined above, or allows the third section to remain wrapped around the wire, first section, and second section. In this embodiment of the method, the third section serves as a transparent overlay, permitting the electrician to read the second section without executing the step of unwrapping the third section, thus saving time via elimination of steps in the method.

In various alternative embodiments, the wires are labeled by adding written indicia and/or pre-printed labels to the label-unit prior to attachment of the label-unit to the wire, after attachment of the label-unit to the wire, or both prior to and after attachment of the label-unit to the wire.

In one embodiment of the method wherein the label-unit utilized contains a gripping section, the gripping section is detached from the label-unit prior to attaching the label-unit to the wire. In an alternative embodiment the gripping section is detached from the label-unit after the label-unit has been attached to the wire.

Alternative Embodiments

The invention is not limited to the label-roll or label-book for transporting or storing a plurality of label-units. With the benefits of the instant disclosure, one skilled in the art could appreciate a variety of ways in which a plurality of label-units may be affixed to one another for easy transport. In sum, the invention advantageously provides a labeling device which includes a self-protective feature in the form of the third section, reduces time expended creating label units, and reduces time expended protectively covering the label-unit, none of which are found in the prior art wire-labeling devices or methods.

The disclosure of each patent, patent application and publication cited or described in this document is hereby incorporated herein by reference, in its entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the invention.

We claim:

1. A wire-label for identifying a wire end, a label-unit comprising two planar sides, one side is a label-face side, and the opposing side is a label-back side, which in part is coated by adhesive, the label-unit is subdivided along its longitudinal length into at least three sections operably connected end to end, the sections consisting of:

a first section, having two ends, a first end and a second end, which when operably connected to a second section sequentially connects the first end distal to the second section, and a second end connected to an end of the second section, the first section having an adhesive surface on the label-back side;

a second section, having two ends, a first end and a second end, which when in operable connection, the first end of the second section connected to the second end of the first section proximal thereto, and the second end of the second section connected to an end of a third section proximal thereto, the second section having no adhesive surface on either planar side, thereby allowing for adding written indicia to identify the wire end; and a third section having two ends, a first end which is connected to the proximal second end of the second section, and a second end which is distal to the second section, the third section having an adhesive surface on the label-back side.

2. The wire-label of claim 1, wherein the label-unit further comprises a fourth section operably-connected to one end of the label unit, the fourth section having two nonadhesive, planar sides, and having two ends, a first end and a second end, wherein the first end is operably-connected to the proximal first end of the first section, and the second end, in operable configuration, is a manual gripping surface for the wire label.

3. A plurality of label units of claim 2, operably assembled and longitudinally connected end-to-end, such that the first end of the gripping section of one label unit is operably connected to the second end of the third section of a preceding label unit of the plurality, and the connection is repeated in subsequent wire label units in continuous, overlapping series in a label-roll, such that the adhesive back side of each label-unit is proximal to a roll-core, and the face side of each label-unit is distal to the roll-core.

4. The plurality of label-units of claim 3, further comprising a plurality of repeated lines or perforations at the point at which each first end of the gripping section of one label unit is operably connected to the second end of the third section of a preceding label unit of the plurality, perpendicularly-oriented and transversely crossing the continuous roll of label-units, thereby separating each label-unit from the adjacent label-unit.

5. A label-roll of wire-labels, comprising a plurality of label-units of claim 3 in continuous series, wherein the label-units are wound and overlap around an axis located at the center of a roll-core.

6. The plurality of label-units of claim 2, operably assembled as a label- book, wherein each label-unit is symmetrically and repeatedly overlaid over top of another label-unit.

7. A label-book of wire-labels, comprising a plurality of label-units of claim 6, wherein each label-unit is symmetrically and repeatedly overlaid on top of another label-unit.

8. A plurality of the label-units of claim 1, operably assembled and longitudinally connected end-to-end, such that the first end of the first section of one label unit is operably connected to the second end of the third section of a preceding label unit of the plurality, and the connection is repeated in subsequent wire label units in continuous, overlapping series in a label-roll, such that the adhesive back side of each label-unit is proximal to a roll-core, and the face side of each label-unit is distal to the roll-core.

9. The plurality of label-units of claim 8, further comprising a plurality of repeated lines or perforations at the point at which each first end of the first section of one label unit is operably connected to the second end of the third section of a preceding label unit of the plurality, perpendicularly-oriented and transversely crossing the continuous roll of label-units, thereby separating each label-unit from the adjacent label-unit.

10. A label-roll of wire-labels, comprising a plurality of label-units of claim 8 in continuous series, wherein the label-units are wound and overlap around an axis located at the center of a roll-core.

11. The plurality of label-units of claim 1, operably assembled as a label-book, wherein each label-unit is symmetrically and repeatedly overlaid over top of another label-unit.

12. A label-book of wire-labels, comprising a plurality of label-units of claim 11, wherein each label-unit is symmetrically and repeatedly overlaid on top of another label-unit.

13. A method for labeling a wire and protecting the labels during wire installation, using the wire-labels of claim 1, the method comprising:

applying the first end of the first section of a label-unit to the wire;

wrapping the first section of the label-unit around the wire;

wrapping the second section of the label-unit around the wire, covering the first section on the wire; and wrapping the third section of the label-unit entirely around the wire, covering the second section over the first section on the wire, leaving no portion of the label-unit unapplied, thereby smoothly covering and protecting the second section of the label-unit comprising the written indicia.

14. The method of claim 13, further comprising labeling the second section of the label-unit with written indicia on one or both sides, prior to applying the first section of the label-unit to the wire.

15. The method of claim 13, further comprising labeling the second section of the label-unit with written indicia on one or both sides, after applying the first section of the label-unit to the wire.

16. The method of claim 13, further comprising unwrapping the third section of the label-unit, thereby exposing the written indicia on the second section.

17. The method of claim 16, further comprising detaching the third section of the label-unit after unwrapping said third section.

18. A method for labeling a wire and protecting the labels during wire installation, using a wire-label for identifying a wire end, a label-unit comprising two planar sides, one side is a label-face side, and the opposing side is a label-back side, which in part is coated by adhesive, the label-unit is subdivided along its longitudinal length into at least three sections operably connected end to end, the sections consisting of:

a first section, having two ends, a first end and a second end, which when operably connected to a second section sequentially connects the first end distal to the second section, and a second end connected to an end of the second section, the first section having an adhesive surface on the label-back side;

a second section, having two ends, a first end and a second end, which when in operable connection, the first end of the second section connected to the second end of the first section proximal thereto, and the second end of the second section connected to an end of a third section proximal thereto, the second section having no adhesive surface on either planar side, thereby allowing for adding written indicia to identify the wire end;

a third section having two ends, a first end which is connected to the proximal second end of the second section, and a second end which is distal to the second section, the third section having an adhesive surface on the label-back side; and a fourth section operably-connected to one end of the label unit, the fourth section having two nonadhesive, planar sides, and having two ends, a first end and a second end, wherein the first end is operably-connected to the proximal first end of the first section, and the second end, in operable configuration, is a manual gripping surface for the wire label;

the method comprising:

applying the first end of the first section of a label-unit to the wire while holding the gripping surface of the fourth gripping section;

wrapping the first section of the label-unit around the wire, either over the gripping section or after removing the gripping section;

wrapping the second section of the label-unit around the wire, covering the first section on the wire; and wrapping the third section of the label-unit entirely around the wire, covering the second section over the first section on the wire, leaving no portion of the label-unit unapplied, thereby smoothly covering and protecting the second section of the label-unit comprising the written indicia.

19. The method for exposing the protected second section of the wire label of claim 18, comprising unwrapping the third section of the label-unit, thereby exposing the written indicia on the second section.

20. The method of claim 19, further comprising detaching the third section of the label-unit after unwrapping said third section.

* * * * *